US007691034B2

(12) United States Patent
May et al.

(10) Patent No.: US 7,691,034 B2
(45) Date of Patent: Apr. 6, 2010

(54) TOTAL BODY ELLIPTICAL EXERCISE DEVICE WITH INDEPENDENT UPPER AND LOWER BODY MOTION

(75) Inventors: Gregory B. May, Seattle, WA (US); James S. Birrell, Seattle, WA (US); Peter J. Arnold, Snohomish, WA (US); Thomas H. Moran, Madison, WI (US); Phillip S. Lamb, Point Loma, CA (US)

(73) Assignee: Precor Incorporated, Woodinville, WA (US)

( * ) Notice: Subject to any disclaimer, the term of this patent is extended or adjusted under 35 U.S.C. 154(b) by 1434 days.

(21) Appl. No.: 11/070,748

(22) Filed: Mar. 2, 2005

(65) Prior Publication Data

US 2006/0199701 A1 Sep. 7, 2006

(51) Int. Cl.
*A63B 22/06* (2006.01)
*A63B 22/12* (2006.01)

(52) U.S. Cl. ..... 482/52; 482/62

(58) Field of Classification Search ..... 482/1–148
See application file for complete search history.

(56) References Cited

U.S. PATENT DOCUMENTS 4,555,109 A * 11/1985 Hartmann ..... 482/62
4,586,706 A * 5/1986 Chen ..... 482/62
4,625,963 A * 12/1986 Lancellotti ..... 482/130
4,630,817 A * 12/1986 Buckley ..... 463/37
4,757,988 A * 7/1988 Szymski ..... 482/59
5,054,770 A * 10/1991 Bull ..... 482/53
5,908,373 A * 6/1999 Pitre ..... 482/57
6,939,271 B1 * 9/2005 Whan-Tong et al. ..... 482/52
D526,250 S * 8/2006 Trumble et al. ..... D12/111
7,270,625 B2 * 9/2007 Miller ..... 482/52
7,479,093 B1 * 1/2009 Immordino et al. ..... 482/52
7,481,746 B2 * 1/2009 Ibarguren ..... 482/57
2005/0085344 A1 * 4/2005 Eschenbach ..... 482/51
2006/0293153 A1 * 12/2006 Porth et al. ..... 482/52

* cited by examiner

*Primary Examiner*—Steve R Crow
(74) *Attorney, Agent, or Firm*—Terrence P. O'Brien; Todd A. Rathe; Paul E. Schaafsma

(57) ABSTRACT

An elliptical exercise device includes a frame having a first pivot axis and a longitudinal axis, at least one foot link and at least one swing arm. The foot link is coupled to the frame and is constrained to move in an orbital path approximately parallel to the longitudinal axis. The swing arm is also coupled to the frame and has a reciprocating movement whereby a natural "stride" movement of the arm of a user is replicated. The swing arm operates independently from the foot link. The natural "stride" movement of the arm of the user grasping the arm link follows a generally concave motion relative to the ground. The length of the movement of the arm of the user is defined by the user. A different resistive load can be applied on the arm apparatus than on the foot links.

55 Claims, 10 Drawing Sheets

TOTAL BODY ELLIPTICAL EXERCISE DEVICE WITH INDEPENDENT UPPER AND LOWER BODY MOTION

FIELD OF THE INVENTION

The present invention relates to exercise equipment.

BACKGROUND OF THE INVENTION

The benefits of regular aerobic exercise are well established. However, due to time constraints, inclement weather, and other reasons, many people are prevented from aerobic activities such as walking, jogging, running, and swimming. In response, a variety of exercise equipment has been developed for aerobic activity. It is generally desirable to exercise a large number of different muscles over a significantly large range of motion so as to provide for balanced physical development, to maximize muscle length and flexibility, and to achieve optimum levels of aerobic exercise. It is further advantageous for exercise equipment to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised. Another type of exercise device simulates stair climbing. These devices exercise more muscles than stationary bicycles; however, the rather limited range of up-and-down motion utilized does not exercise the user's leg muscles through a large range of motion. Treadmills are still a further type of exercise device in the prior art. Treadmills allow natural walking or jogging motions in a relatively limited area. A drawback of the treadmill, however, is that significant jarring of the hip, knee, ankle and other joints of the body may occur through use of this device.

A further limitation of a majority of exercise systems in the prior art lies in the limits in the types of motions that they can produce. Relatively new classes of exercise devices are capable of producing elliptical motion. Exercise systems create elliptical motion, as referred to herein, when the path traveled by a user's feet while using the exercise system follows an arcuate or ellipse-shaped path of travel. Elliptical motion is much more natural and analogous to running, jogging, walking, etc., than the linear-type, back and forth motions produced by some prior art exercise equipment.

Exercise devices that can provide arm and shoulder motions as well as arcuate foot motions are also desirable. Prior art devices utilize arm and shoulder motions that are linked to foot motions. These linked devices incorporate forced coordinated motion, where the motions of a user's feet are linked to the motions of a user's arms and shoulders. Thus, the user's feet are forced to move in response to the movement of the user's arms and shoulders (in substantially an equal and opposite amount), and vice versa.

One drawback to these linked devices lies in the ability of the user during operation to unintentionally exert little or no force on the arm apparatuses due to the linkage with the foot links. The arm apparatus travels through a given path regardless of whether the user is exerting any force on the arm due to the force being exerted on the foot links. The opposite drawback can also occur where too much force is being exerted on the arm apparatus, thereby diminishing the amount of force required to be exerted on the foot apparatuses. a corollary drawback is the inability to place a different resistive load on the arm apparatus than on the foot links or to vary the load placed on the arm links relative to the load placed on the foot links.

A further drawback is that, in existing machines the arm links travel a full stroke length, in conjunction with the foot links. This can lead to arm movements that are not consistent with the natural movement of the arms, particularly when a user operates the machine at a rapid pace. Also, a person with shorter arms may desire a different arm stroke length than a taller person.

In addition, in the prior art devices where the arm and shoulder motions that are linked to foot motions, the given path through which the arm travels follows a generally convex movement relative to the ground where the forward-most and rearward-most positions of the handles are lower than the mid-travel position of the handle. This generally convex motion is in contrast to the natural motion of the arms during running, which follow a generally concave motion relative to the ground.

What would thus be desirable is an exercise device that provides for smooth natural action, exercises a relatively large number of muscles through a large range of elliptical motion, employs arm, shoulder, and rotational movement, and provides for safety and stability. Such an exercise device would assure that the user exerts a proper or desired amount of arm and shoulder force. Such an exercise device would allow a user to place and vary a different resistive load on the arm apparatus than on the foot links. Such an exercise device would provide a more natural path for the arms. Such an exercise device would provide a full body elliptical exercise experience that allowed for a user to define, and vary as desired, the stroke length of the arm links.

SUMMARY OF THE INVENTION

An exercise device in accordance with the principles of the present invention provides for smooth natural action, exercises a relatively large number of muscles through a large range of elliptical motion, employs arm, shoulder and rotational movement, and provides for safety and stability. An exercise device in accordance with the principles of the present invention assures that the user exerts a proper amount of arm and shoulder force. An exercise device in accordance with the principles of the present invention allows a user to place and vary a different resistive load on the arm apparatus than on the foot links. An exercise device in accordance with the principles of the present invention provides a more natural path for the arms. An exercise device in accordance with the principles of the present invention provides a full body elliptical exercise experience that allows for a user to define, and vary as desired, the stroke length of the arm links.

In accordance with the present invention, an exercise device is provided having a frame defining a longitudinal axis, the frame having a rearward portion and a forward portion. A pair of foot links include a rearward portion that is constrained to move in an orbital path approximately parallel to the longitudinal axis and a forward portion that reciprocally engages the guide track. A left swing arm and a right swing arm are provided, both having a reciprocating movement. The swing arms operate independently from the foot links. The swing arms are connected to the frame by a pair of pivotal connection points, thereby imparting a three-point reciprocating movement whereby a natural "stride" movement of the arm of a user is replicated. The natural "stride" movement of the arm of the user follows a generally concave motion relative to the ground. Because the swing arms operate independently from the foot links, the length of the movement of the arm of the user is defined by the user. In addition, because the swing arms operate independently from the foot links, a different resistive load can be applied on the arm apparatus than on the foot links.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

While an exemplary embodiment of the invention has been illustrated and described, it will be appreciated that various changes can be made therein without departing from the spirit and scope of the invention.

Figure 1:
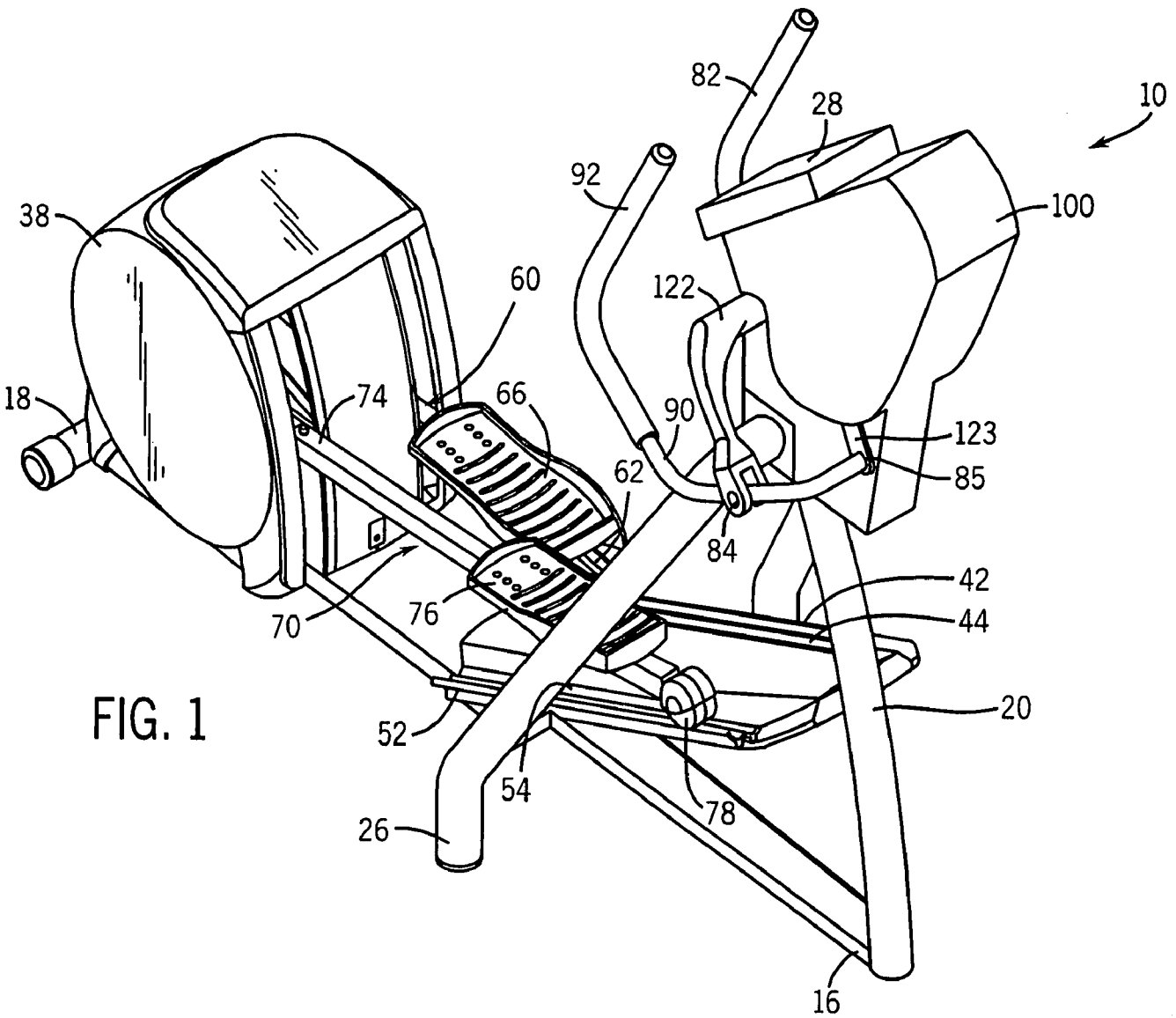
FIG. 1 illustrates an elevated front perspective view of an exercise device in accordance with the principles of the present invention.
Figure 2:
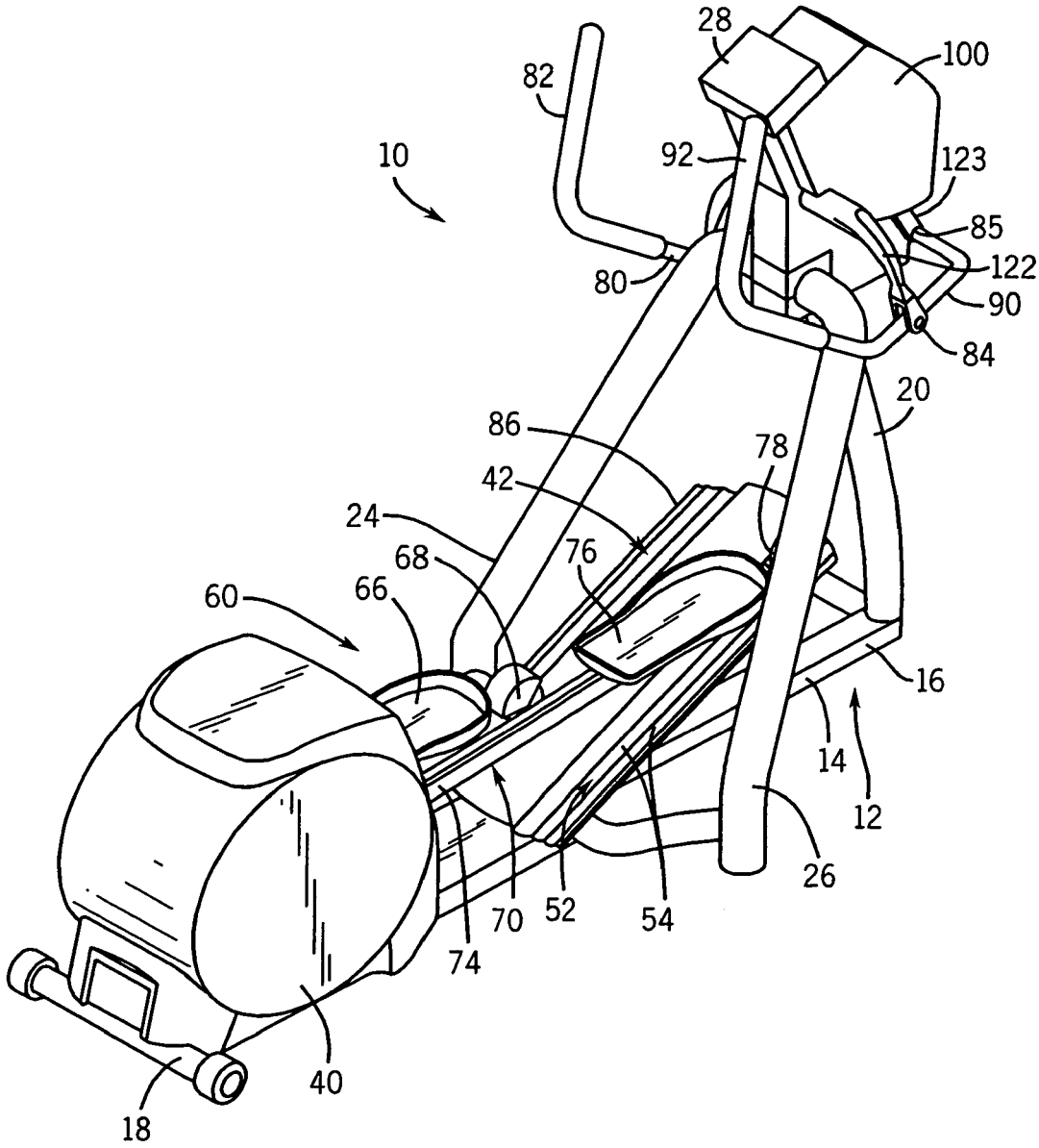
FIG. 2 illustrates an elevated rear perspective view of the exercise device of FIG. 1.
Figure 3:
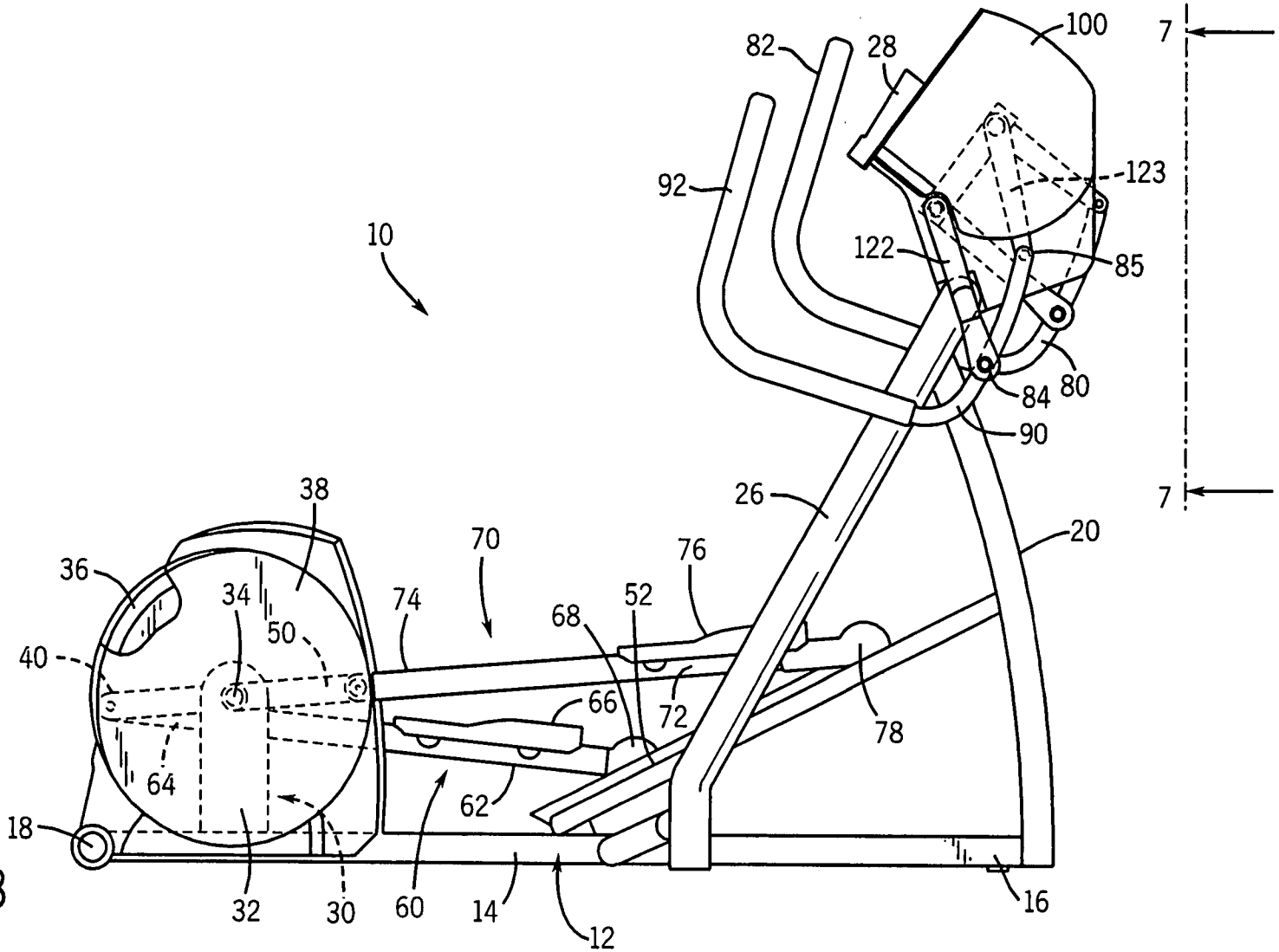
FIG. 3 illustrates a side view of the exercise device of FIG. 1.

FIGS. 1-3 illustrate an embodiment of an exercise device 10 constructed in accordance with the principles of the present invention that exercises both the upper and lower body in independent motion. Briefly described, the exerciser 10 includes a frame 12 that has a forward upright member 20. The forward upright member 20 extends upwardly and curves slightly rearwardly from a substantially horizontal, longitudinal central member 14 of the frame 12. Left and right axle mounts 30, 32 extend upwardly towards the rear region of the frame 12.

Left and right foot links 60, 70 each include a forward portion 62, 72, a rearward portion 64, 74, and a foot support portion 66, 76 there between. The rearward portions 64, 74 of the foot links 60, 70 engage a pair of crank arm assemblies 40, 50 such that the foot support portions 66, 76 of the foot links travel in an elliptical reciprocal path as the transverse axle 34 rotates.

The forward portions 62, 72 of the foot links 60, 70 preferably are supported by rollers 68, 78, which engage guide tracks 42, 52 that are mounted to the frame 12. In one embodiment of the present invention, the guide tracks can be statically mounted to the frame 12, preferably in an angled position with a forward end of the guide tracks 42 and 52 positioned at a higher elevation than a rearward end of the guide tracks 42 and 52. In an alternative embodiment, the guide tracks can incorporate a mechanism such as a motor (not shown) and a lead screw (not shown) for selectively adjusting the inclination of the guide tracks.

Left and right swing arm members 80, 90, are provided. The swing arm members 80, 90 further contain left and right hand-gripping portions 82, 92. The swing arm members 80, 90 are further connected to swing arm mechanics contained within housing 100, as will be explained in greater detail below.

More particularly, the frame 12 includes the longitudinal central member 14 that terminates at forward and rearward portion portions 16, 18. Preferably, the forward portion 16 of the frame 12 simply terminates at the end of the longitudinal central member 14, while the rearward portion 18 terminates as a relatively shorter transverse member. Alternatively, other frame configurations can be employed including, for example, a shorter transverse member being positioned at forward portion of the frame as well. Ideally, but not essentially, the frame 12 is composed of tubular members that are relatively light in weight but that provide substantial strength and rigidity. The frame 12 may also be composed of solid members that provide the requisite strength and rigidity while maintaining a relatively lightweight.

The forward upright member 20 extends upwardly and slightly rearwardly from the forward portion 16 of the floor-engaging frame 12. Preferably, the upright member 20 is slightly rearwardly curved; however, the forward member 20 may be configured at other upward angles without departing from the scope of the present invention. Left and right balance arms 24, 26 depend downwardly from each end of the cross-bar member 22 to engage the floor on each side of the longitudinal central member 14 near the forward portion of the exercise device 10, thereby increasing stability. Ideally, but not essentially, these members are composed of a material similar to that described above, and are formed in quasi-circular tubular configurations.

Preferably, a view screen 28 is securely coupled to the upper portion of the forward upright member 20, at an orientation that is easily viewable to a user of the device 10. Instructions for operating the device as well as courses being traveled may be located on the view screen 24 in an exemplary embodiment. In some embodiments of the present invention, electronic devices may be incorporated into the exerciser device 10 such as timers, odometers, speedometers, heart rate indicators, energy expenditure recorders, controllers, etc. This information may be routed to the view screen 28 for ease of viewing for a user of the device 10.

In the exemplary embodiment shown in FIG. 3, the axle mounts 30, 32 are located toward the rearward portion 18 of the frame 12. The axle mounts 30, 32 are attached to the frame 12 and extend approximately upward from the substantially horizontal, longitudinal central member 14. The transverse axle 34 is rotatably housed in the upper region of the axle mounts 30, 32. These regions of the axle mounts 30, 32, which house the ends of the transverse axle 34, contain low friction engaging systems (not shown), such as bearing systems, to allow the transverse axle 34 to rotate with little resistance within the housing in the axle mounts 30, 32.

As shown in FIGS. 1-3, the foot links 60, 70 are illustrated in the shape of elongated, relatively thin beams. The foot links 60, 70 are aligned in approximately parallel relationship with the longitudinal central member 14 of the frame 12. The foot support portions 66, 76 are positioned near the forward portion of the foot links 60, 70, and provide stable foot placement locations for the user of the device. Alternatively, the foot support portions can be positioned at any location between the front and rear ends of the foot link. In some exemplary embodiments the foot support portions 66, 76 are configured to form toe straps and/or toe and heel cups (not shown) which aid in forward motion recovery at the end of a rearward or forward striding motion of a user's foot.

Referring again to the exemplary embodiment shown in FIG. 3, the transverse axle 34 is preferably operatively coupled to a flywheel 36 contained within a center housing 38. Such flywheels are known in the art. However, in other embodiments, the transverse axle 34 may not incorporate a flywheel 36 and/or central housing 38, without departing from the scope of the present invention (provided that the foot links 60, 70 are coupled to one another in some fashion, albeit directly or indirectly). The transverse axle 34 may also be operatively connected to a capstan-type drive (not shown) in some embodiments, to allow the axle 34 to rotate in only one direction.

In an alternate embodiment of the present invention the rearward portions 64, 74 of the foot links 60, 70 are rotationally connected directly to a flywheel which functions to couple the foot links 60, 70 to a pivot axis (equivalent to the axis of the transverse axle 34) and permit rotation thereabout. In this embodiment, the flywheel is preferably a double flywheel that supports rotation about a central axis. Various mechanical arrangements may be employed to embody the crank arm assemblies 40, 50 in operatively connecting the foot links 60, 70 to each other. Such variations may include a larger flywheel, a smaller flywheel, or may eliminate the flywheel entirely and incorporate a cam system with connecting linkage, provided that the foot links are coupled so as to permit an arcuate path of travel by the foot support portions 66, 76 of the foot links 60, 70.

A first resistance applicator such as a braking system can be further provided for the operation of the left and right foot links 60 and 70. The brake system can be an eddy current brake assembly. The eddy current brake assembly includes a solid metallic disk configured to operate in association with the flywheel. Ideally, an annular faceplate of highly electrically conductive material, e.g., copper, is mounted on the face of the solid disk. A pair of magnet assemblies are mounted closely adjacent the face of the solid disk opposite the annular plate. The magnet assemblies each include a central core in the form of a bar magnet surrounded by a coil assembly. The magnet assemblies are positioned along the outer perimeter portion of the disk in alignment with the annular plate. The location of the magnet assemblies may be adjusted relative to the adjacent face of the disk so as to be positioned as closely as possible to the disk without actually touching or interfering with the rotation of the disk. In alternative preferred embodiments, the first resistance applicator can incorporate other types of loading mechanisms, such as for example viscous drag, a disc brake, other friction brakes, a generator, an alternator, etc.

Figure 4:
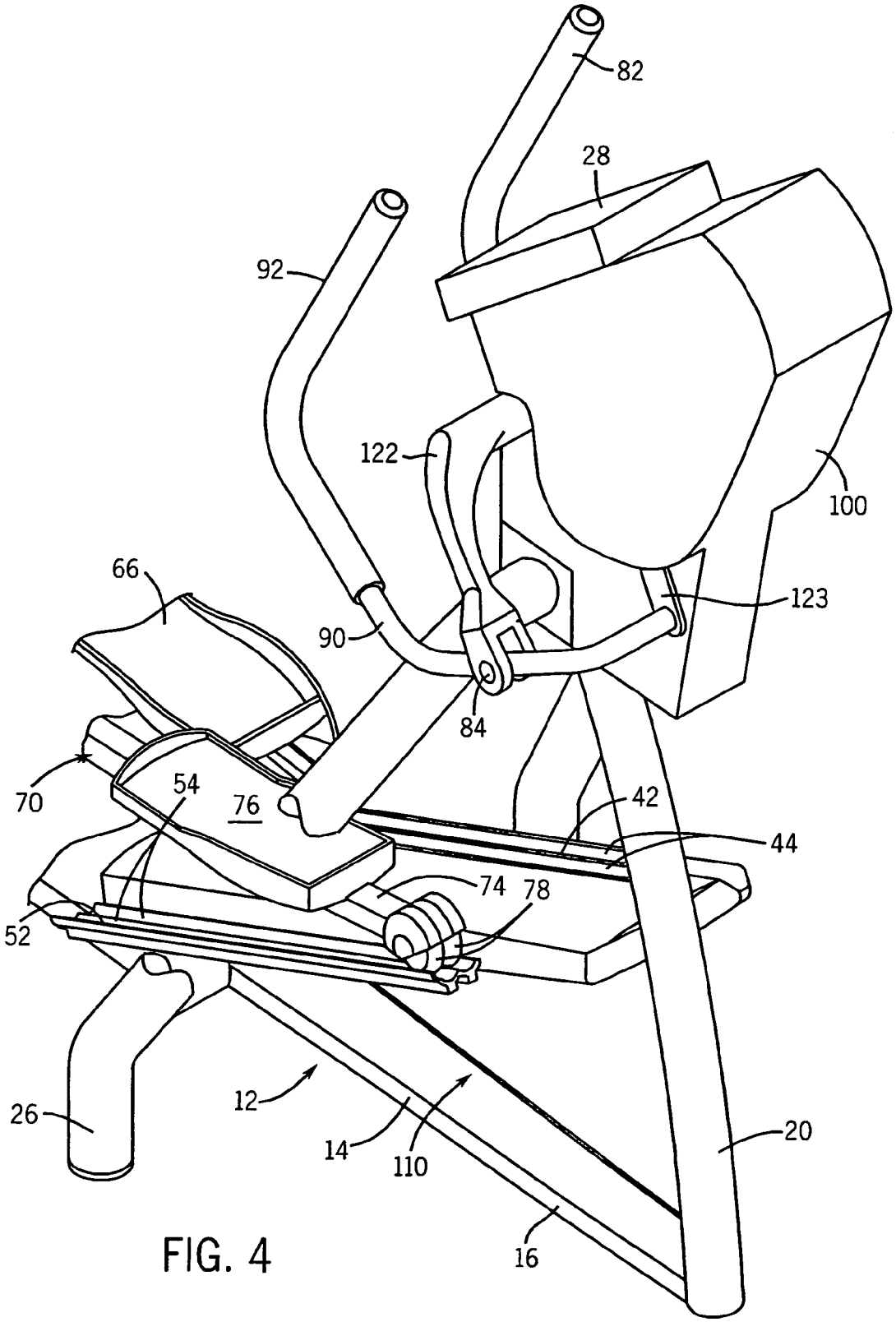
FIG. 4 illustrates a close-up perspective view of a portion of the exercise device of FIG. 1 that includes the abutment arm and curved attachment link of the engagement assembly.
Figure 5:
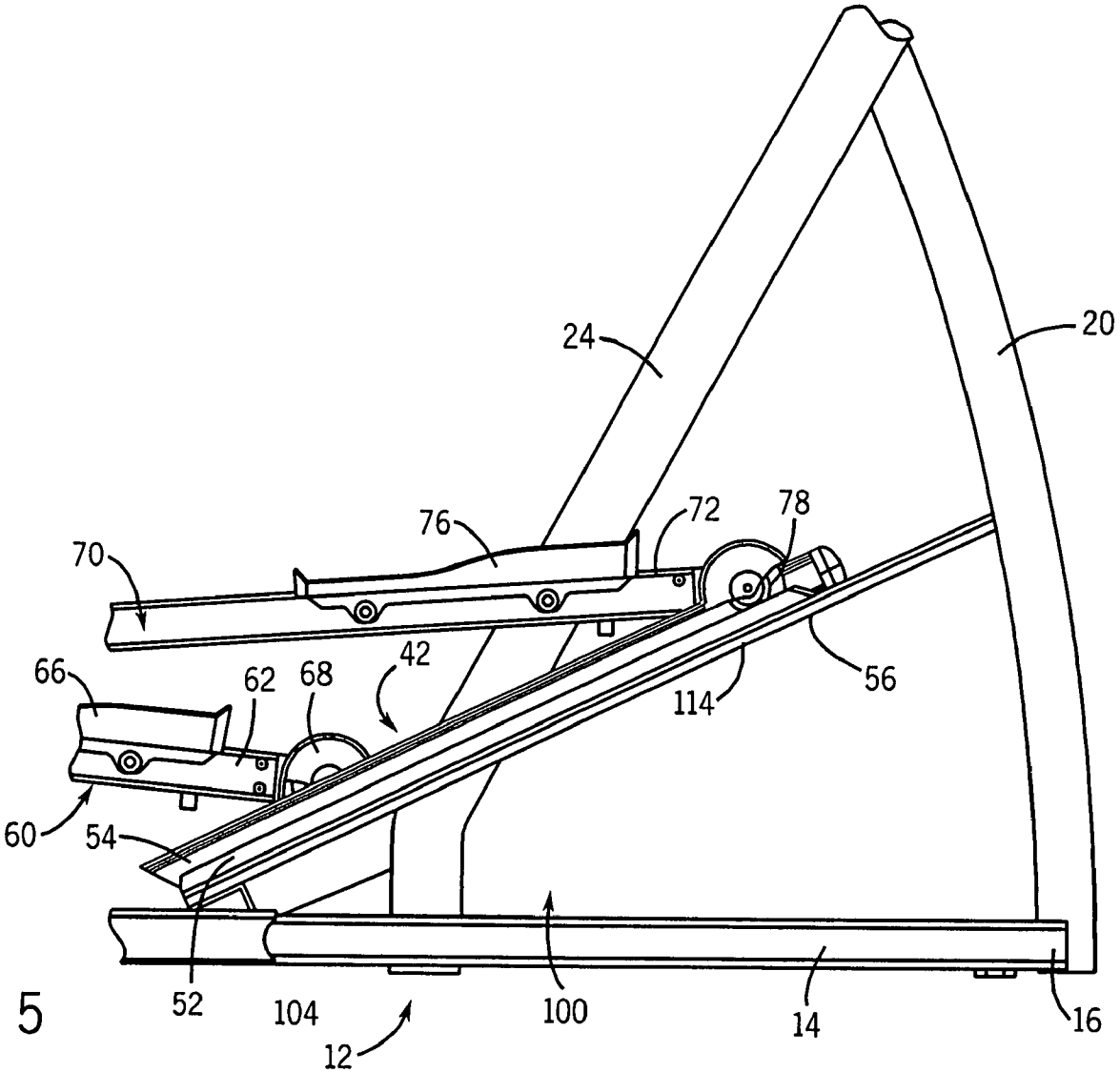
FIG. 5 illustrates a close-up side view of the exercise device of FIG. 1 that includes the abutment arm and curved attachment link of the engagement assembly.

As most clearly shown in FIGS. 4-5, the exercise device 10 further contains left and right guide tracks 42, 52. The guide tracks 42, 52 can be completely separate members, or can be part of one single connected unit (as shown in FIGS. 4 and 5). The guide tracks 42, 52 attach to the longitudinal central member 14 of the frame 12 at an angled inclination. In one embodiment, the angle of inclination is approximately 30 degrees. In one embodiment, the guide tracks 42, 52 can be connected to a height adjustment mechanism that can raise and lower the guide tracks 42, 52 thereby adjusting the angle of inclination.

Preferably, the upper surface of the guide tracks 42, 52 is shaped to contain two longitudinally extending, adjacent engagement grooves 44, 54. These engagement grooves 44, 54 give the upper surface of the guide tracks 42, 52 a generally "W-shaped" cross-sectional configuration. The engagement grooves 44, 54 are specifically sized and shaped to correspondingly mate with the rollers 68, 78 of the foot links 60, 70 in order to assist in the lateral containment of the rollers 68, 78 on the guide tracks. In addition, the lower surface of the guide tracks 42, 52 preferably contain longitudinally extending stabilizing troughs 46, 56 (see FIG. 4).

The left and right forward portions 62, 72 of the foot links 60, 70 terminate in left and right engagement rollers 68, 78. The left and right engagement rollers 68, 78 ride along the above-described grooves 44, 54 of the guide tracks 42, 52. Preferably, the engagement rollers 68, 78 are actually pairs of rollers. The engagement rollers 68, 78 rotate about axles that are affixed to the forward portions 62, 72 of the foot links 60, 70. During use of the exercise device 10, the engagement rollers 68, 78 at the front of the foot links 60, 70 translate back and forth the length of the guide tracks 42, 52 in rolling engagement within the grooves 44, 54, as the foot support portions 66, 76 of the foot links 60, 70 travel in an arcuate path of motion, and the rearward portions 64, 74 of the foot links 60, 70 rotate about the transverse axle 34. In an alternate embodiment of the present invention, the engagement rollers 68, 78 could be replaced with sliding engagement mechanisms without departing from the scope of the present invention.

Referring again to FIGS. 1-3, the exerciser device 10 contains left and right swing arm members 80, 90 containing a hand-gripping portion 82, 92. The swing arm members 80, 90 are rotatably coupled to the forward upright member 20 of the frame 12 at their respective pivot points 84, 94. The pivot points 84, 94 rotatably secure the swing arm members 80, 90 to each end of the crossbar member 22 of the frame 12. The hand-gripping portions 82, 92 of the swing arm members 80, 90 are grasped by the hands of the individual user, and allow upper body arm and shoulder exercising motions to be incorporated. When a user increases the speed with which he or she runs, the length of travel of the arms of the user typically shortens. A drawback of exercise devices of the prior art is that the course of travel is defined by the linkage between the swing arm members and the foot links, thereby imposing an arm path on the user. An exercise device 10 that is constructed in accordance with the present invention allows upper body arm and shoulder exercising motions to be incorporated independent of the elliptical exercising motion traced out by the user's feet. An exercise device in accordance with the principles of the present invention provides for a user defined arm stroke length as opposed to a machine-defined or fixed stroke, thereby enabling user's of different heights, age, physical condition, arm lengths to select an arm stroke length that best fits their needs. Further, the user-defined arm stroke length can be varied by the user automatically during exercise. For example, a user using a total body elliptical machine at an average or slow pace will typically desire a longer arm stroke length than when the same user uses the elliptical machine at a very rapid pace.

Figure 6:
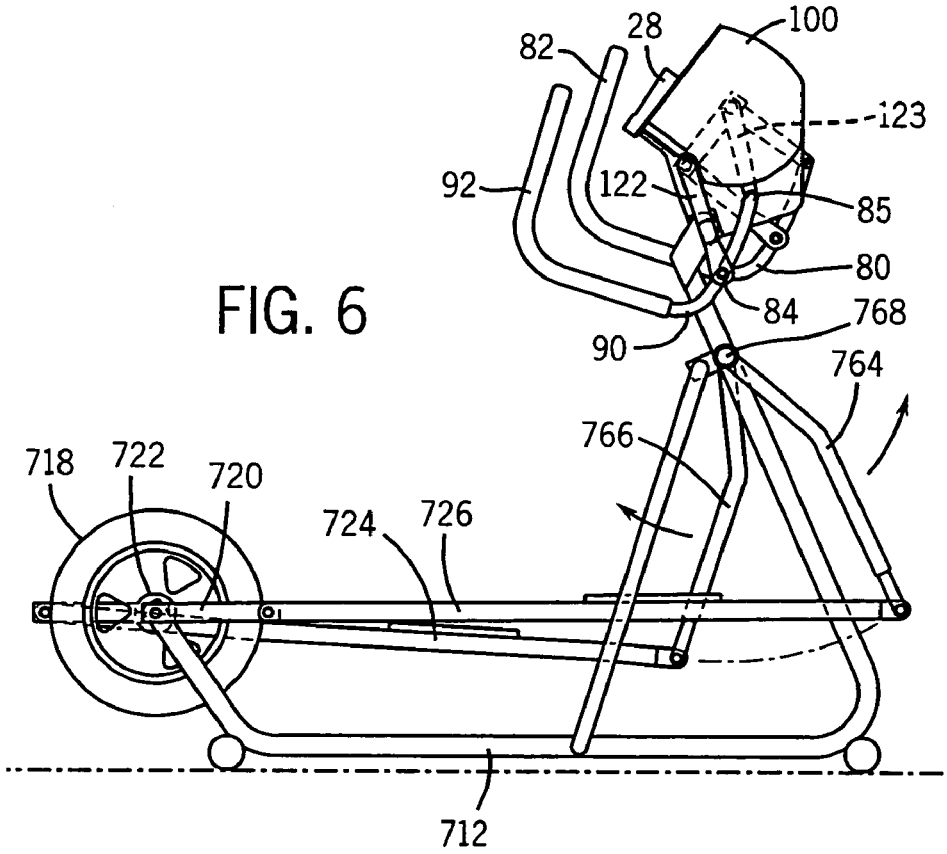
FIG. 6 is a side view of an elliptical exercise device in accordance with an alternative preferred embodiment of the present invention.
Figure 7:
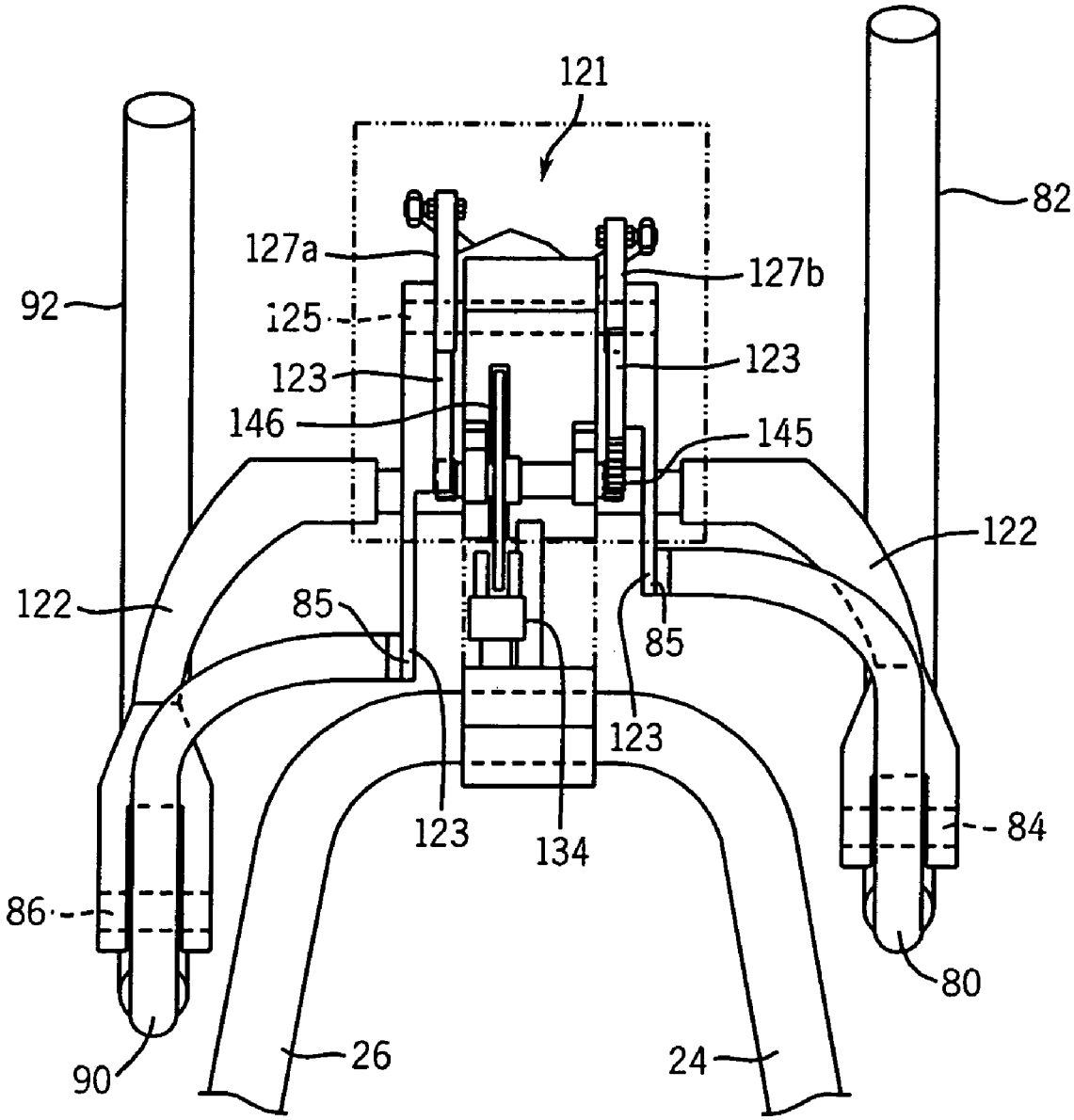
FIG. 7 is a frontal view the arm mechanism in accordance with the principles of the present invention.
Figure 8:
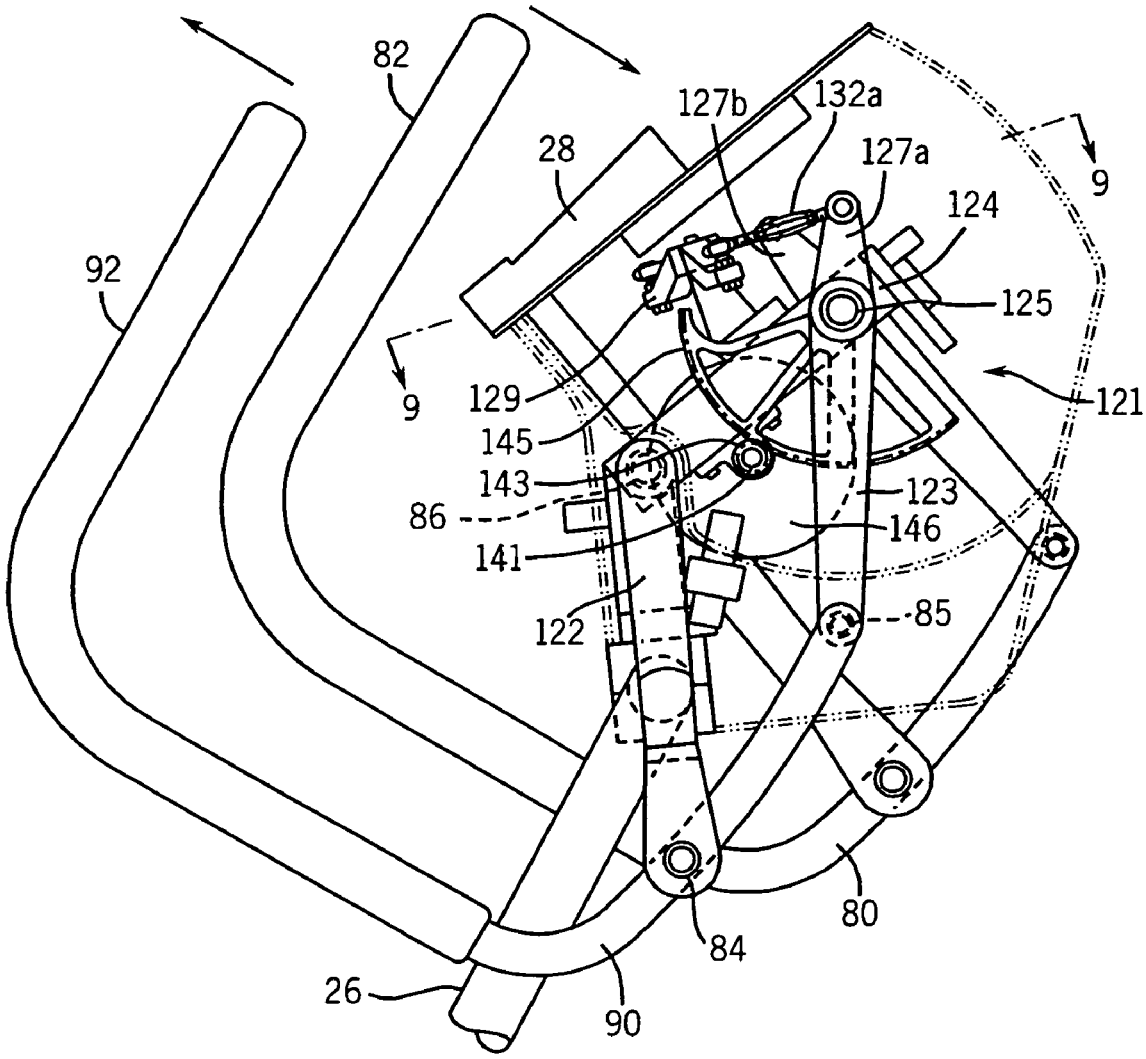
FIGS. 8 and 9 are side views of the arm mechanism in accordance with the principles of the present invention.
Figure 9:
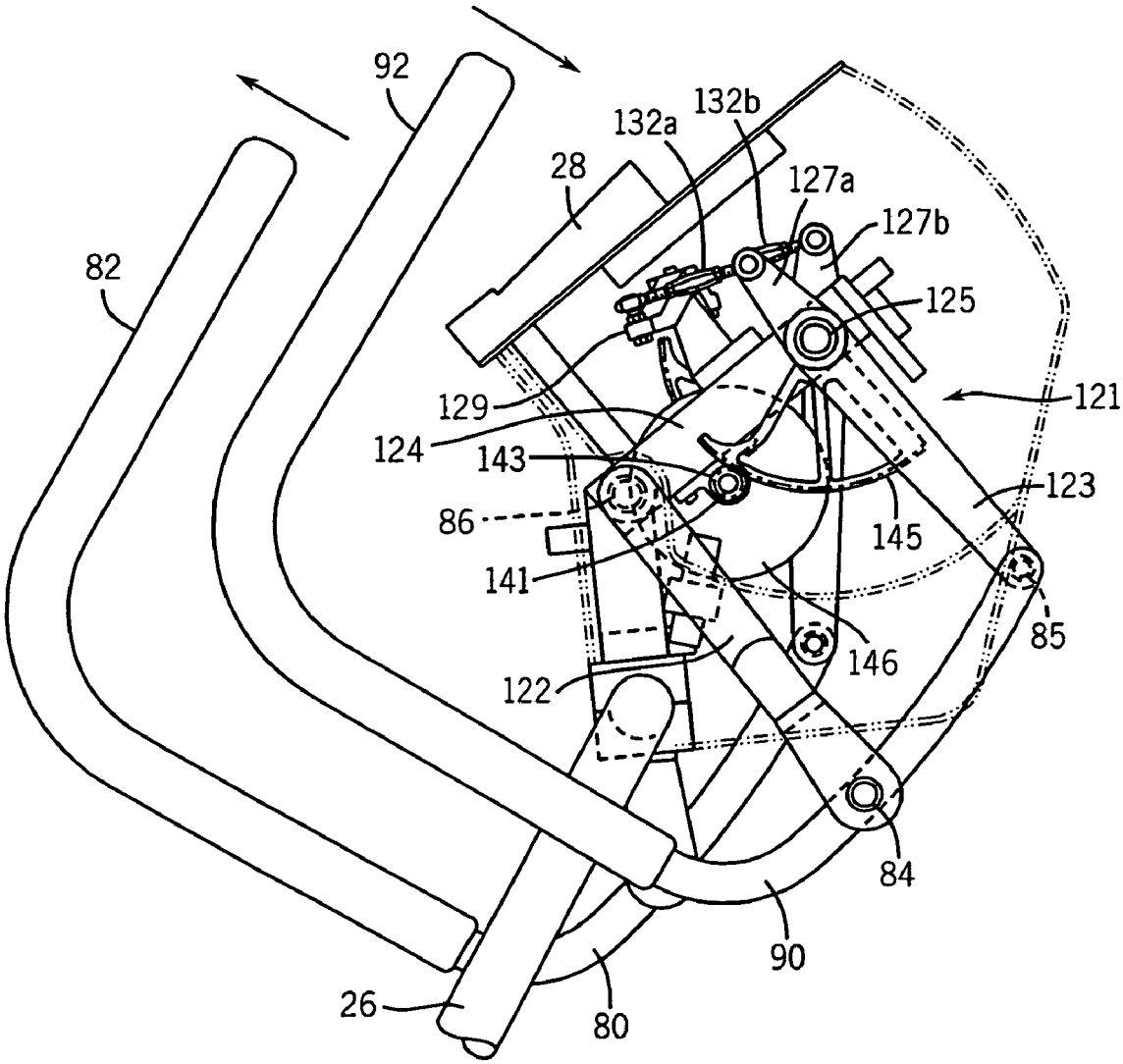

Referring to FIGS. 6-10, a swing arm mechanism 121 in accordance with the principles of the present invention is seen. FIG. 7 is a frontal view of the swing arm mechanism 121 of the present invention. FIGS. 8 and 9 are side views of the swing arm mechanism 121 of the present invention. For ease of description, one side only of the swing arm mechanism 121 will be described in detail.

The swing arm member 90 is connected to a pivot arm 122 at a first pivot point 84. In addition, the swing arm member 90 is pivotally coupled to a reciprocating arm 123 at pivot point 85 on a support 124, thus providing a four-bar linkage. The reciprocating arm 123 is operably connected to a gear assembly 143, 145, described in detail below. The pivot arm 122 reciprocates back and forth about an axis defined by a pivotal connection 86 with support 124 thereby imparting reciprocal back and forth movement on the swing arm member 90. Extending in front of pivot point 84, the swing arm member 90 curves inwardly, ending in a pivotal connection 85 to a reciprocating arm 123. The reciprocating arm 123 extends downwardly from a pivot point 125 to swing arm member 90. The reciprocating arm 123 reciprocates back and forth about the axis defined by the pivot point 125, thereby imparting a second reciprocal back and forth movement on the swing arm member 90.

Thus, reciprocating arm 123 and pivot arm 122 impart a reciprocating movement on the swing arm member 90. In a first position seen in FIG. 8, the swing arm member 90 is relatively extended forward; in a second position seen in FIG. 9, the arm member 90 is relatively extended rearward. In one advantage of a device in accordance with the principles of the present invention, by allowing upper body arm and shoulder exercising motions to be incorporated independent of the elliptical exercising motion traced out by the user's feet, the given path through which the arm travels can be provided as a generally concave motion relative to the ground. This is in accordance with the natural path the arms seek out during exercising on such a device. Thus, by utilizing this reciprocating movement on the swing arm member 90 the natural "stride" movement of the user's arm is replicated. The concave arm motion preferably results in the lowest point in the path of travel of the user's hand occurring at a position between the forward and rearward most positions of the path of travel. This natural concave arm motion is the opposite of the arm motion present on existing total body elliptical exercise devices, which force the arm motion along a generally convex path with respect to the floor when viewed from the side of the exercise device.

Figure 10:
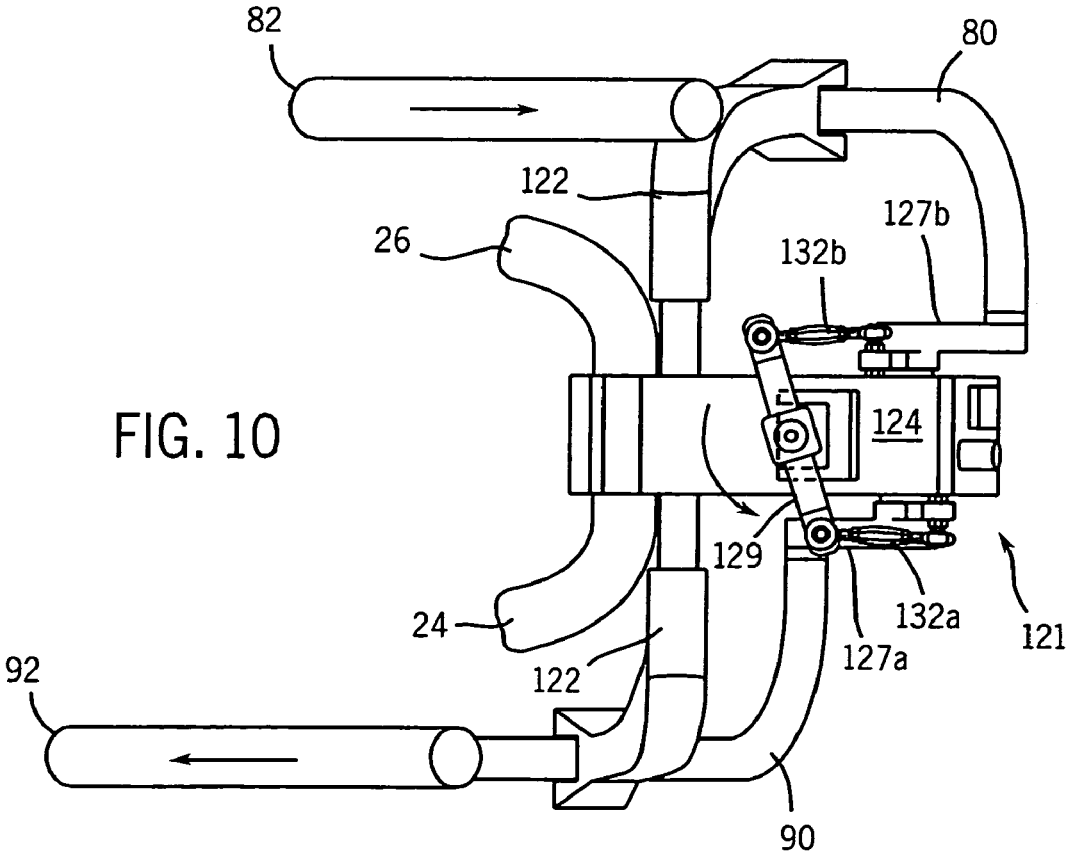
FIG. 10 is an overhead view of the arm mechanism in accordance with the principles of the present invention.

The reciprocating arm 123 includes a link extension 127*a* that extends upwardly from the pivot point 125. The link arm 127*a* is fixedly secured to reciprocating arm 123 and thus reciprocates back and forth in opposition to the reciprocating arm 123 about the pivot point 125. As best seen in FIG. 10, the link arm 127*a* is secured to a linkage member 129 by a support arm 132*a*. The linkage member 129 is likewise connected to a second link arm 127*b* by a second support arm 132*b*. The second link arm 127*b* is fixedly secured to a second reciprocating arm and likewise extends upwardly from a second pivot point. The second link arm 127*b* thus reciprocates back and forth in opposition to the second reciprocating arm about the second pivot point. Thus, in one embodiment the linkage member 129 provides a direct mechanical connection between the left and right swing arm members 80, 90 to ensure the inverse timing of the movements of the left and right swing arm members 80, 90. In another embodiment, the linkage member 129 can be omitted thereby enabling the user to move the left and right swing arms independently of each other. For example, if a user desired to move both the left and right swing arms forward and backward in tandem, this embodiment would allow for this motion. This embodiment also enables the user to change the motion of the left swing arm in relation to the right swing arm at any time during the exercise, thereby increasing the flexibility of the total body elliptical exercise device. In another embodiment, a mechanism can be provided for the left and right swing arm members 80, 90 to define an arm path for the user.

A stub shaft 141 is provided attached to forward upright member. The stub shaft 141 is connected to a spur gear 143. The spur gear 143 is connected to the stub shaft 141 by a slip gear transmission. The spur gear 143 cooperates with a partial spur gear 145 connected to the reciprocating arm 123. Thus, the slip gear transmission is engaged when the reciprocating arm 123 moves in one direction, but is disengaged when the reciprocating arm 123 moves in the opposite direction. Thus, gear assembly 143, 145 transfers energy from the pivotal motion of swing arm members 80, 90 to rotational energy through gears 143, 145. While the embodiment described herein utilizes a spur gear and partial spur gear assembly, additional assemblies that transfer energy from the pivotal motion of swing arm members 80, 90 to rotational energy can be used, such as for example friction drive, belts, pulleys, other types of gears, etc. In a further embodiment, a flywheel (not seen) can be provided to smooth the natural "stride" movement of the swing arm members 80, 90. The flywheel can be held in housing attached to the forward upright member 20. The flywheel can be mounted on a stub shaft 141 rotatably extending transversely through the housing.

A second resistance applicator such as a braking system 134 (FIG. 7) can be further provided for the swing arm mechanism 121. The brake system 134 can be an eddy current brake assembly. The eddy current brake assembly 134 includes a solid metallic disk 146 also mounted on stub shaft 141 to also rotate with the flywheel. Ideally, an annular faceplate of highly electrically conductive material, e.g., copper, is mounted on the face of the solid disk. A pair of magnet assemblies are mounted closely adjacent the face of the solid disk opposite the annular plate. The magnet assemblies each include a central core in the form of a bar magnet surrounded by a coil assembly. The magnet assemblies are positioned along the outer perimeter portion of the disk in alignment with the annular plate. The location of the magnet assemblies may be adjusted relative to the adjacent face of the disk so as to be positioned as closely as possible to the disk without actually touching or interfering with the rotation of the disk. While the embodiment described herein utilizes a an eddy current brake assembly, additional resistance applicators can be utilized such as for example viscous drag, a disc brake, other friction brakes, a generator, an alternator, etc.

In one embodiment, a single resistance applicator system can be used to apply a resistance to the operation of the both the swing arms and the foot links. However, preferably, first and second resistance applicators are used wherein the first resistance applicator applies a load to the operation of the foot links and the second resistance applicator applies a load to the operation of the arm links. The first and second resistance applicators operate independently and can provided different variable loads the foot links and the swing arms.

To use the present invention, the user stands on the foot support portions 66, 76 and grasps the hand-gripping portions 82, 92. The user imparts a rearward stepping motion on one of the foot support portions and a forward stepping motion on the other foot support portion, thereby causing the transverse axle 34 to rotate in a clockwise direction (when viewed from the right side as shown in FIG. 1), due to the crank arm assemblies 40, 50 coupling the motion of the foot links 60, 70 to the rotation of the transverse axle 34. Independent of the lower body action, the user imparts a substantially forward pushing motion on one of the hand-gripping portions and a substantially rearward pulling motion on the other hand-gripping portion.

Figure 11:
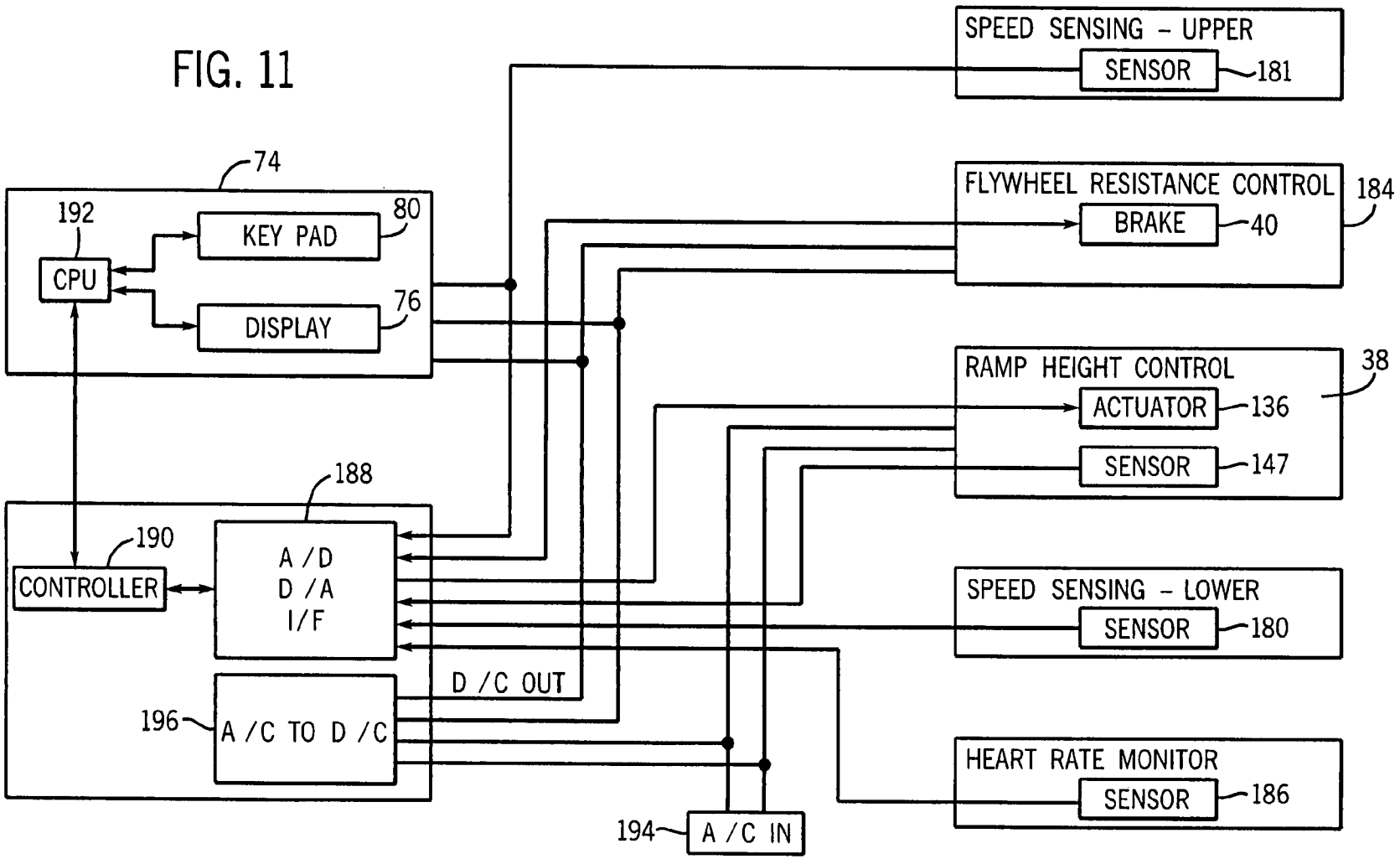
FIG. 11 is a schematic of a system for controlling and coordinating a desired workout level in accordance with the principles of the present invention.

A system for controlling and coordinating the angle of inclination of the guide tracks 42, 52 and the resistance applied to the rotation of the flywheels 24 to achieve a desired workout level is illustrated schematically in FIG. 11. A physical workout parameter, e.g., user's heart rate, is monitored by a sensor 186. An electrical signal, typically analog in nature, related to the user's heart rate is generated. Various types of heart rate monitors are available, including chest worn monitors, ear lobe monitors and finger monitors. The output from the monitor 186 is routed through an analog to digital interface 188, through controller 190 and to a central processing unit (CPU) 192, ideally located within display panel 28. In addition to, or in lieu of, the user's heart rate, other physical parameters of the exerciser may be utilized, including respiratory rate, age, weight, sex, etc.

The exercise control system 184 of the present invention includes an alternating current power inlet 194 connectable to a standard amperage AC 110 volt power supply. The power inlet 194 is routed to a transformer 196 and then on to a brake systems and the display 28. Typically, the height adjustment mechanism utilizes AC power, and thus, is not connected to the transformer 196. The height adjustment mechanism can include a sensing system 147 to sense the angle of inclination of the guide tracks 42, 52 and an actuator 136 to effectuate the adjustment. This information is routed through the analog to digital interface 188, through controller 190 and to the CPU 192.

The rotational speeds of each of the flywheels can also be monitored. A first sensor 180 can be provided to monitor the lower body flywheel 36. A second sensor 181 can be provided to monitor the upper body flywheel. Speed information is transmitted to the CPU through the analog to digital interface 188 and controller 190. Thus, during use the CPU is apprised of the heart rate or other physical parameter of the exerciser being sensed by sensor 186, the angle of inclination of the guide tracks 42, 52, and the speeds of the flywheels. This information, or related information, may be displayed to the exerciser through display 28.

Further, through the present invention, a desired workout level may be maintained through the control system 184. For instance, certain parameters may be inputted by the exerciser, such as age, height, and sex, to achieve a desired heart rate range during exercise. Alternatively, the desired heart rate range may be directly entered by the exerciser. Other parameters may or may not be inputted by the exerciser, such as the desired speed of the flywheel corresponding to cycles per minute of the foot links and/or inclination of the guide tracks 42, 52. With this information, the control system of the present invention can adjust the braking systems and/or the height adjustment mechanism to achieve the desired workout level.

It is to be understood that various courses or workout regimes may be preprogrammed into the CPU 192 or designed by the user to reflect various parameters, including a desired cardiovascular range, type of stepping action, etc. The control system 184 thereupon will control the brake system as well as the height adjustment mechanism to correspond to the desired workout regime.

Referring to FIG. 6, an alternative embodiment of the present invention is illustrated. In this alternative embodiment, the swing arm members 90 and associated assemblies are substantially the same as described above. In the alternative embodiment, the frame 712 includes first and second pivot axes 722 and 768. A pair opposing crank arms 720 extend from the first axis 722 and couple to the rearward ends of first and second foot links 724 and 726. A flywheel 718, or other inertial loading device, is operably coupled to the first axis 722. Additional resistance or loading mechanisms (not shown) can also be operably coupled to the first axis 722, the crank arms 720 and/or the flywheel 718 to provide adjustable loading to the operation of the foot links 724 and 726. First and second pivot links 764 and 766 are pivotally coupled to the frame 712 at the second axis 768, and are also pivotally coupled to the forward ends of the first and second foot links 724 and 726. In this configuration, the forward ends of the first and second foot links 724 and 726 travel in a reciprocating arcuate path of travel as the crank arms rotate about the first axis 722.

While the invention has been described with specific embodiments, other alternatives, modifications and variations will be apparent to those skilled in the art. Accordingly, it will be intended to include all such alternatives, modifications and variations set forth within the spirit and scope of the appended claims.

What is claimed is:

1. An elliptical exercise device, comprising:

a frame having a first pivot axis and a longitudinal axis;

at least one foot link coupled to the frame, the foot link being constrained to move in an orbital path approximately parallel to the longitudinal axis;

at least one swing arm coupled to the frame, the swing arm having a reciprocating movement, the swing arm operating independently from the foot link, wherein the at least one swing arm includes a left swing arm and a right swing arm; and a linkage member pivotal about a substantially vertical axis and operably coupling the left and right swing arms to impart an inverse relationship to the movements of the left and right swing arms, wherein each swing arm is coupled to the frame through at least a pair of pivotal connection points thereby imparting a reciprocating movement.

2. The exercise device of claim 1, further comprising a first resistance mechanism coupled to the at least one swing arm.

3. The exercise device of claim 2, further wherein the first resistance mechanism is an eddy current brake assembly.

4. The exercise device of claim 1, wherein the at least one swing arm includes a left swing arm and a right swing arm, and wherein the at least one foot link includes a left foot link and right foot link.

5. The exercise device of claim 1 further including a guide track coupled to the frame, wherein the foot link includes at least one roller, and the guide track has an upper surface that is adapted to rollably receive the foot link roller and that reciprocally engages the guide track.

6. The exercise device of claim 5, wherein the guide track is angled with respect to a horizontal plane.

7. The exercise device of claim 4, further including first and second crank arm assemblies coupled to the frame at the first pivot axis, the first and second crank arm assemblies coupled to rearward ends of the left and right foot links, respectively.

8. The exercise device of claim 7, further including and first and second pivot links pivotally coupled to the frame, and the first and second pivot links pivotally coupled to forward ends of the left and right foot links, respectively, such that movement of the first and second crank arm assemblies about the pivot axis causes the forward ends of the foot links to reciprocate along a curved path.

9. The exercise device of claim 1, further comprising a flywheel, wherein the foot link is rotationally coupled to the flywheel.

10. The exercise device of claim 1, further comprising a second resistance mechanism coupled to the at least one foot link.

11. The exercise device of claim 10, wherein the second resistance mechanism is an eddy current brake assembly.

12. An elliptical exercise device, comprising:

a frame having a pivot axis and a longitudinal axis;

at least one foot link coupled to the frame, the at least one foot link being constrained to move in an orbital path approximately parallel to the longitudinal axis;

at least one swing arm coupled to the frame and having a reciprocating movement, the at least one swing arm having at least one hand gripping portion and operating independently from the at least one foot link; and at least one resistance applicator that applies a different resistive load on the at least one swing arm than on the at least one foot link, wherein the resistance applicator is forward the at least one hand gripping portion, wherein the at least one swing arm is coupled to the frame through at least a pair of pivotal connection points thereby imparting a reciprocating movement to the at least one swine arm and wherein the at least one swing arm includes left and right swing arms, and a linkage member pivotal about a substantially vertical axis and operably coupling the left and right swing arms to impart an inverse relationship to the movements of the left and right swing arms.

13. The exercise device of claim 12, wherein the at least one resistance applicator includes first and second resistance applicators, and wherein the first resistance applicator applies a first resistance to the at least one swing arm and the second resistance applicator applies a second resistance to the at least one foot link.

14. The exercise device of claim 13, wherein the first resistance is adjustable independently of the second resistance during use of the exercise device.

15. The exercise device of claim 12, wherein the at least one foot link includes a left foot link and right foot link.

16. The exercise device of claim 12 further including a guide track coupled to the frame, wherein the at least one foot link includes at least one roller for reciprocally engaging the guide track, and wherein the guide track has an upper surface that is adapted to rollably receive the at least one roller.

17. The exercise device of claim 16, wherein the guide track is angled with respect to a horizontal plane.

18. The exercise device of claim 15, further including first and second crank arm assemblies coupled to the frame at the first pivot axis, the first and second crank arm assemblies coupled to rearward ends of the left and right foot links, respectively.

19. The exercise device of claim 18, further including and first and second pivot links pivotally coupled to the frame, and the first and second pivot links pivotally coupled to forward ends of the left and right footlinks, respectively, such that movement of the first and second crank arm assemblies about the pivot axis causes the forward ends of the foot links to reciprocate along a curved path.

20. The exercise device of claim 12, further comprising a flywheel, wherein the at least one foot link is rotationally coupled to the flywheel.

21. An elliptical exercise device, comprising:

a frame having a pivot axis and a longitudinal axis;

at least one foot link coupled to the frame, the foot link being constrained to move in an orbital path approximately parallel to a longitudinal axis; and at least one swing arm coupled to the frame and having a reciprocating movement, the at least one swing arm following a generally concave reciprocating motion relative to the ground, wherein the at least one swing arm is coupled to the frame as part of a four bar linkage including:

a support;

a pivot arm having a first portion pivotally connected to the support about a first axis and a second portion;

a reciprocating arm having a first portion pivotally connected to the support about a second axis and a second portion;

wherein the swing arm is pivotally connected to the second portion of the pivot arm about a third axis below the first axis and the second axis and wherein the swing arm is pivotally connected to the second portion of the reciprocating arm about a fourth axis below the first axis and the second axis.

22. The exercise device of claim 21, further wherein the at least one swing arm operates independently from the at least one foot link.

23. The exercise device of claim 21, wherein the at least one swing arm is coupled to the frame through at least a pair of pivotal connection points.

24. The exercise device of claim 21, wherein the at least one swing arm includes a left swing arm and a right swing arm, and further includes a linkage member pivotal about a substantially horizontal axis and operably coupling the left and right swing arms to impart an inverse relationship to the movements of the left and right swing arms.

25. The exercise device of claim 21 wherein the generally concave reciprocating motion of the swing arm defines a generally reciprocating concave path of travel, and wherein the lowest point along the path of travel occurs at a location between the forward most and rearward most ends of the path of travel.

26. The exercise device of claim 21, further comprising a first resistance mechanism coupled to the at least one swing arm.

27. The exercise device of claim 26, further wherein the first resistance mechanism is an eddy current brake assembly.

28. The exercise device of claim 21, wherein the at least one swing arm includes a left swing arm and a right swing arm, and wherein the at least one foot link includes a left foot link and right foot link.

29. The exercise device of claim 21 further including a guide track coupled to the frame, wherein the foot link includes at least one roller, and the guide track has an upper surface that is adapted to rollably receive the foot link roller and that reciprocally engages the guide track.

30. The exercise device of claim 29, wherein the guide track is angled with respect to a horizontal plane.

31. The exercise device of claim 28, further including first and second crank arm assemblies coupled to the frame at the first pivot axis, the first and second crank arms coupled to reward ends of the left and right foot links, respectively.

32. The exercise device of claim 31, further including and first and second pivot links pivotally coupled to the frame, and the first and second pivot links pivotally coupled to forward ends of the left and right footlinks, respectively, such that movement of the first and second crank arm assemblies about the pivot axis causes the forward ends of the foot links to reciprocate along a curved path.

33. The exercise device of claim 21, further comprising a flywheel, wherein the at least one foot link is rotationally coupled to the flywheel.

34. The exercise device of claim 21, further comprising a second resistance mechanism coupled to the at least one foot link.

35. The exercise device of claim 34, wherein the second resistance mechanism is an eddy current brake assembly.

36. An elliptical exercise device, comprising:

a frame having a pivot axis and a longitudinal axis;

at least one foot link coupled to the frame, the foot link being constrained to move in an orbital path approximately parallel to a longitudinal axis; and at least one swing arm coupled to the frame and having a reciprocating movement, the swing arm configured to produce a reciprocating stroke length defined by the user that is independent of the motion of the foot link, wherein the reciprocating stroke length follows a curved path that is concave with respect to the ground and wherein the reciprocating stroke length is adjustable by the user without discontinuing use of the exercise device, wherein the at least one swing arm includes a left swing arm and a right swing arm, and further including a linkage member operably coupling the left and right swing arms to impart an inverse relationship to the movements of the left and right swing arms.

37. The exercise device of claim 36, wherein the reciprocating stroke length is automatically adjustable by the user with each stroke of the user's arm.

38. The exercise device of claim 36, wherein each swing arm is coupled to the frame through at least a pair of pivotal connection points.

39. The exercise device of claim 36, further comprising a first resistance mechanism coupled to the at least one swing arm.

40. The exercise device of claim 39, wherein the first resistance mechanism is an eddy current brake assembly.

41. The exercise device of claim 36, wherein the at least one foot link includes a left foot link and right foot link.

42. The exercise device of claim 36 further including a guide track coupled to the frame, wherein the at least one foot link includes at least one roller, and the guide track has an upper surface that is adapted to rollably receive the at least one roller and that reciprocally engages the guide track.

43. The exercise device of claim 42, wherein the guide track is angled with respect to a horizontal plane.

44. The exercise device of claim 41, further including first and second crank arm assemblies coupled to the frame at the first pivot axis, the first and second crank arm assemblies coupled to rearward ends of the left and right foot links, respectively.

45. The exercise device of claim 44, further including first and second pivot links pivotally coupled to the frame, and the first and second pivot links pivotally coupled to forward ends of the left and right footlinks, respectively, such that movement of the first and second crank arm assemblies about the pivot axis causes the forward ends of the foot links to reciprocate along a curved path.

46. The exercise device of claim 36, further comprising a flywheel, wherein the foot link is rotationally coupled to the flywheel.

47. The exercise device of claim 36, further comprising a second resistance mechanism coupled to the at least one foot link.

48. The exercise device of claim 47, further wherein the second resistance mechanism is an eddy current brake assembly.

49. The exercise device of claim 1, wherein the at least one swing arm is coupled to the frame as part of a four bar linkage including:

a support;

a pivot arm having a first portion pivotally connected to the support about a first axis and a second portion;

a reciprocating arm having a first portion pivotally connected to the support about a second axis and a second portion;

wherein the swing arm is pivotally connected to the second portion of the pivot arm about a third axis below the first axis and the second axis and wherein the swing arm is pivotally connected to the second portion of the reciprocating arm about a fourth axis below the first axis and the second axis.

50. The exercise device of claim 1 further comprising at least one resistance applicator applies a different resistance load on the at least one swing arm than on the foot links, wherein the at least one swing arm includes at least one hand gripping portion and wherein the resistance applicator is forward the at least one hand gripping portion.

51. The exercise device of claim 1, wherein the reciprocating movement follows a curved path that is concave with respect to the ground and wherein the reciprocating movement has a length that is adjustable by the user independent of motion of the at least one foot link without discontinuing use of the exercise device.

52. The exercise device of claim 12, wherein the reciprocating movement follows a curved path that is concave with respect to the ground and wherein the reciprocating movement has a length that is adjustable by the user independent of motion of the at least one foot link without discontinuing use of the exercise device.

53. The exercise device of claim 21, wherein the reciprocating movement follows a curved path that is concave with respect to the ground and wherein the reciprocating movement has a length that is adjustable by the user independent of motion of the at least one foot link without discontinuing use of the exercise device.

54. The exercise device of claim 36, wherein the at least one swing arm is pivotally coupled to the frame such that the reciprocating stroke length is adjustable and user defined by the user moving the at least one swing arm through different reciprocating stroke lengths without any further alterations of the exercise device.

55. An elliptical exercise device, comprising:

a frame having a pivot axis and a longitudinal axis;

at least one foot link coupled to the frame, the foot link being constrained to move in an orbital path approximately parallel to a longitudinal axis;

at least one swing arm coupled to the frame and having a reciprocating movement, the swing arm configured to produce a reciprocating stroke length defined by the user that is independent of the motion of the foot link, wherein the reciprocating stroke length follows a curved path that is concave with respect to the ground and wherein the reciprocating stroke length is adjustable by the user without discontinuing use of the exercise device; and an eddy current brake assembly coupled to the at least one swing arm.

* * * * *

UNITED STATES PATENT AND TRADEMARK OFFICE

CERTIFICATE OF CORRECTION

PATENT NO. : 7,691,034 B2
APPLICATION NO. : 11/070748
DATED : April 6, 2010
INVENTOR(S) : May et al.

It is certified that error appears in the above-identified patent and that said Letters Patent is hereby corrected as shown below:

On the title page item (74) Attorney, Agent, or Firm should read - Terence P. O'Brien; Todd A. Rathe; Paul E. Schaafsma Signed and Sealed this Eighteenth Day of May, 2010

David J. Kappos

David J. Kappos
*Director of the United States Patent and Trademark Office*